US010329994B2

(12) United States Patent
Rieber et al.

(10) Patent No.: US 10,329,994 B2
(45) Date of Patent: Jun. 25, 2019

(54) POWER TOOL

(71) Applicant: Andreas Stihl AG & Co. KG, Waiblingen (DE)

(72) Inventors: Martin Rieber, Stuttgart (DE); Thorsten Schäffer, Neulingen (DE); Jens Riehmann, Stuttgart (DE); Arno Kinnen, Fellbach (DE); Volker Donner, Aspach (DE)

(73) Assignee: Andreas Stihl AG & Co. KG, Wailblingen (DE)

( * ) Notice: Subject to any disclaimer, the term of this patent is extended or adjusted under 35 U.S.C. 154(b) by 0 days.

(21) Appl. No.: 13/707,724

(22) Filed: Dec. 7, 2012

(65) Prior Publication Data

US 2014/0000537 A1 Jan. 2, 2014

(30) Foreign Application Priority Data

Dec. 7, 2011 (DE) ..... 10 2011 120 464

(51) Int. Cl.

| | |
|---|---|
| ***F01P 1/00*** | (2006.01) |
| ***F01P 1/10*** | (2006.01) |
| ***F01P 5/06*** | (2006.01) |
| ***B25F 5/00*** | (2006.01) |
| ***F02M 69/10*** | (2006.01) |
| ***F02M 37/20*** | (2006.01) |
| *F02M 35/10* | (2006.01) |

(52) U.S. Cl.

CPC ..... *F01P 1/00* (2013.01); *B25F 5/008* (2013.01); *F01P 1/10* (2013.01); *F01P 5/06* (2013.01); *F02M 37/20* (2013.01); *F02M 69/10* (2013.01); *F01P 2025/48* (2013.01); *F02M 35/1017* (2013.01)

(58) Field of Classification Search

CPC ..... F01P 1/02; F01P 5/02; F01P 5/06; F01P 2001/023; F01P 2001/026; F01P 1/06; F01P 1/08; F01P 1/10; F02B 63/02

USPC ..... 123/41.65, 41.58, 392

See application file for complete search history.

(56) References Cited

U.S. PATENT DOCUMENTS

| | | | |
|---|---|---|---|
| 3,805,758 | A | 4/1974 | May |
| 4,205,637 | A | 6/1980 | Ito et al. |
| 4,253,433 | A | 3/1981 | Blair |
| 4,438,733 | A | 3/1984 | Sasaki |
| 4,596,219 | A | 6/1986 | Kemmner |

(Continued)

FOREIGN PATENT DOCUMENTS

| | | | |
|---|---|---|---|
| CA | 2251764 | A1 | 10/1997 |
| CN | 1 497 158 | A | 5/2004 |

(Continued)

*Primary Examiner* — Lindsay M Low
*Assistant Examiner* — Omar Morales
(74) *Attorney, Agent, or Firm* — Gudrun E. Huckett

(57) ABSTRACT

A power tool has an internal combustion engine with an injection valve through which fuel is supplied to the internal combustion engine; a crankcase; and a crankshaft arranged in the crankcase so as to be rotatable about an axis of rotation. A fan wheel housing is provided and a fan wheel is arranged in the fan wheel housing and conveys cooling air to the internal combustion engine. In the fan wheel housing a connecting opening is formed. The injection valve is arranged in a cooling area, wherein cooling air is supplied by the fan wheel through the connecting opening to the cooling area.

10 Claims, 4 Drawing Sheets

(56) References Cited

U.S. PATENT DOCUMENTS

| | | | | |
|---|---|---|---|---|
| 4,608,957 | A | 9/1986 | Kemmner | |
| 4,903,655 | A | 2/1990 | Vonderau et al. | |
| 5,142,934 | A | 9/1992 | Persson et al. | |
| 5,201,288 | A * | 4/1993 | Doragrip | F02M 69/10 123/73 A |
| 5,243,936 | A * | 9/1993 | Kobayashi | F02B 75/007 123/188.14 |
| 5,419,686 | A | 5/1995 | Wissmann et al. | |
| 5,488,933 | A | 2/1996 | Pham | |
| 5,526,843 | A | 6/1996 | Wolf et al. | |
| 5,664,532 | A | 9/1997 | August | |
| 5,673,670 | A | 10/1997 | Powell et al. | |
| 5,699,761 | A | 12/1997 | Yamaguchi et al. | |
| 5,727,506 | A | 3/1998 | Tajima et al. | |
| 5,899,179 | A | 5/1999 | Sasaki et al. | |
| 5,934,257 | A | 8/1999 | Ishikawa et al. | |
| 5,967,120 | A | 10/1999 | Blanton et al. | |
| 6,135,071 | A | 10/2000 | Kobayashi et al. | |
| 6,192,840 | B1 * | 2/2001 | Durr | B27B 17/00 123/195 R |
| 6,196,170 | B1 | 3/2001 | Singer et al. | |
| 6,314,922 | B1 * | 11/2001 | Zimmermann | B25F 5/008 123/41.56 |
| 6,701,900 | B1 | 3/2004 | Millar et al. | |
| 6,938,884 | B2 | 9/2005 | Knaus et al. | |
| 7,325,528 | B2 * | 2/2008 | Schieber | F02B 25/14 123/257 |
| 7,552,714 | B2 * | 6/2009 | Maier et al. | 123/406.58 |
| 7,743,751 | B2 | 6/2010 | Yonemoto | |
| 7,814,888 | B2 * | 10/2010 | Roβkamp | F02B 33/04 123/472 |
| 7,909,022 | B2 | 3/2011 | Kato et al. | |
| 2004/0168656 | A1 | 9/2004 | Carlsson et al. | |
| 2008/0105220 | A1 * | 5/2008 | Shiota | F01P 1/02 123/41.65 |
| 2009/0007892 | A1 | 1/2009 | Burkitt | |
| 2009/0114189 | A1 | 5/2009 | Shafer et al. | |
| 2009/0235880 | A1 * | 9/2009 | Ziegs | F01P 5/06 123/41.65 |
| 2010/0186724 | A1 | 7/2010 | Ranganathan et al. | |
| 2010/0196179 | A1 | 8/2010 | Noguchi | |
| 2011/0140707 | A1 | 6/2011 | Böker et al. | |

FOREIGN PATENT DOCUMENTS

| | | | |
|---|---|---|---|
| CN | 1 989 322 | A | 6/2007 |
| DE | 197 32 741 | A1 | 7/1997 |
| EP | 0 280 923 | A2 | 9/1988 |
| EP | 0 440 401 | A1 | 8/1991 |
| EP | 1 403 496 | B1 | 3/2004 |
| EP | 1 614 901 | A1 | 1/2006 |
| EP | 1 772 221 | A1 | 4/2007 |
| EP | 1 775 442 | A1 | 4/2007 |
| GB | 885 152 | A | 12/1961 |
| GB | 2 165 003 | A | 4/1986 |
| JP | S59162353 | | 9/1984 |
| JP | H01318757 | | 12/1989 |
| JP | 03-87866 | | 9/1991 |
| JP | H07208289 | | 8/1995 |
| JP | H08303330 | | 11/1996 |
| JP | 2008 045489 | A | 2/2008 |
| WO | 2005/025822 | A1 | 3/2005 |
| WO | 2011/142859 | A1 | 11/2011 |

* cited by examiner

POWER TOOL

BACKGROUND OF THE INVENTION

The invention relates to a power tool comprising an internal combustion engine to which fuel is supplied through an injection valve, wherein the internal combustion engine has a crankcase in which a crankshaft is rotatably supported so as to rotate about an axis of rotation. The power tool has a fan wheel for conveying cooling air to the internal combustion engine. The fan wheel is disposed in a fan wheel housing.

U.S. 2011/0140707 discloses a hand-held power tool, namely a cut-off machine, having an internal combustion engine in the form of a two-stroke engine that is supplied with fuel through a transfer passage by means of an injection valve. The crankshaft of the internal combustion engine drives a fan wheel arranged in a fan wheel housing. The back wall of the fan wheel housing delimits the crankcase of the internal combustion engine.

When the fuel in the fuel system, in particular in the injection valve, is heated too much, vapor bubbles can form that impair the supply of fuel to the internal combustion engine. In particular in case of fuel systems with low fuel pressure vapor bubble formation is observed already at comparatively low temperatures.

U.S. Pat. No. 6,196,170 discloses a lawn trimmer in which the injection valve is arranged at the output side above the fan wheel. The fuel valve as well as the engine block are therefore cooled by the sucked-in air.

SUMMARY OF THE INVENTION

It is an object of the present invention to provide a power tool of the aforementioned kind in which in a simple way an excellent cooling of the injection valve is achieved.

In accordance with the present invention, this is achieved in that in the fan wheel housing a connecting opening is formed and in that the injection valve is arranged in a cooling area into which cooling air that is conveyed by the fan wheel flows through the connecting opening.

In order to obtain an excellent cooling action of the injection valve and to prevent the formation of vapor bubbles in the injection valve, it is provided to cool the cooling area in which the injection valve is arranged in a targeted fashion. For this purpose, a connecting opening is provided in the fan wheel housing by means of which cooling air that is conveyed by the fan wheel flows into the cooling area. In this way, a targeted and excellent cooling action of the injection valve can be achieved. Accordingly, the connecting opening can be arranged on the suction side or the pressure side of the fan wheel, i.e., the cooling air can thus be sucked through the cooling area into the fan wheel or can be conveyed by the fan wheel into the cooling area. By means of the connecting opening, a targeted cooling action of the injection valve can be achieved that is separate from the cooling action of the cylinder. Through the connecting opening cool air that has not been heated by the internal combustion engine is transported into the cooling area. The cooling area in which the injection valve is arranged has advantageously a comparatively small volume so that an excellent and targeted cooling action is achieved. It is not necessary that the cooling area is a completely closed chamber. It is also not necessary that the injection valve is exposed directly to the cooling air that is coming into the cooling area but it can be indirectly cooled, for example, when the injection valve is arranged in a housing or holder that is arranged in the cooling area. In the cooling area, advantageously further components such as components of the fuel system, sensors or the like can be arranged also.

In particular in case of hand-guided portable power tools such as motor chainsaws, cut-off machines, trimmers or the like and in hand-guided drivable power tools such as lawnmowers or the like, small internal combustion engines, in particular, two-stroke engines are used. These engines, in particular two-stroke engines that run at high speeds heat up greatly in operation. At the same time, there is only little space available because such power tools are to be designed to be as compact as possible in order to ensure simple handling. These internal combustion engines have usually fuel pumps that are mechanically driven by the internal combustion engine and operate usually with comparatively low fuel pressure, for example, less than three bar overpressure, in particular, less than 1 bar overpressure relative to ambient pressure.

As a result of the high temperatures in operation of the internal combustion engine and the minimal pressure in the fuel system, vapor bubble formation is promoted. Vapor bubbles in the fuel system can prevent supply of fuel to the internal combustion engine because the pump output of the pump may be compensated partially or completely by the gas volume that has been formed. Vapor bubbles in the fuel system can therefore prevent operation of the internal combustion engine. In particular in two-stroke engines of hand-guided power tools that are operated at minimal fuel pressure and that produce a lot of heat in a small space, the vapor bubble formation is therefore a problem.

Advantageously, the connecting opening is arranged in an overpressure area of the fan wheel housing so that cooling air is conveyed by the fan wheel into the cooling area in which the injection valve is arranged. However, it can also be advantageous that the connecting opening is arranged in an underpressure area of the fan wheel housing and the cooling air is sucked into the fan wheel housing through the cooling area. In the arrangement of the connecting opening in the overpressure area a greater cooling air flow is provided in comparison to an arrangement in an underpressure area. Therefore, the arrangement in an overpressure area is particularly advantageous with regard to an effective cooling action. The connecting opening is advantageously connected by an air guiding passage with the cooling area so that a targeted guiding of the cooling air in the cooling area is possible. A simple configuration results when the cooling area is delimited by an air guiding component. Advantageously, the air guiding passage is also delimited by the air guiding component. In this way, a simple configuration is provided. The air guiding component is comprised advantageously at least partially of plastic material. The air guiding component acts then in a thermally insulating way. When the internal combustion engine is turned off, an excessive heating of the air guiding component by heat transfer from the still hot internal combustion engine is thus avoided in particular. In this way, excessive heat transmission onto the injection valve and thus vapor bubble formation in the injection valve can be prevented when the internal combustion engine is shut off and still hot. The air guiding component is advantageously arranged on the outer circumference of the crankcase. The cooling area in which the injection valve is arranged is advantageously delimited by the crankcase and the air guiding component.

The internal combustion engine is advantageously a mixture-lubricated internal combustion engine (fuel/oil mixture lubrication). The internal combustion engine can be a two-stroke engine or a four-stroke engine that is mixture-lubricated. The injection valve feeds the fuel advantageously directly into the crankcase interior. The fuel/air mixture formation is realized advantageously in the crankcase interior. The supply of fuel directly into the crankcase interior ensures excellent lubrication of the parts in the crankcase. Moreover, the injection valve can be arranged on the crankcase that in operation is significantly cooler than the cylinder of the internal combustion engine. The injection valve can be positioned on the crankcase comparatively far removed from the hot cylinder in order to keep the heat transmission onto the injection valve as minimal as possible. The injection valve is in particular arranged in a holder of plastic material which is attached to the crankcase and is arranged at least partially in the cooling area. The injection valve is therefore not directly exposed to the flow of the cooling air that is conveyed by the fan wheel but can be cooled indirectly by the holder. The surface of the holder is actively cooled. The reduced temperature of the holder leads to a reduced temperature of the injection valve or to a reduced heating of the injection valve. The holder of plastic material reduces also the heat transmission from the crankcase to the injection valve. In particular when the internal combustion engine is turned off, when cooling air is no longer conveyed, an excessive heating of the injection valve can therefore be avoided. The fuel is advantageously supplied to the injection valve by means of a fuel pressure damper. A simple configuration is provided when the fuel pressure damper is integrated into the holder of the injection valve. In this way, the cooling air flow that is conveyed through the connecting opening not only cools the injection valve but also the fuel pressure damper. The fuel pressure damper is advantageously also arranged in the cooling area.

The crankcase has advantageously a first and a second housing part between which a joint surface is formed. At the joint surface the two housing parts are advantageously connected to each other, in particular by interposition of a gasket. The joint surface is advantageously at least partially positioned in an imaginary parting plane. The joint surface may completely extend within the parting plane or can have, for example, at least one step so that only a section of the joint surface is located within the imaginary parting plane. The parting plane is oriented such that an imaginary extension of the joint surface is positioned perpendicular to the axis of rotation of the crankshaft, in this context, the arrangement of the joint surface relative to the axis of rotation of the crankshaft should be substantially perpendicular. Deviations of a few angle degrees relative to the exact perpendicular orientation are of no consequence. The parting plane is positioned parallel to the longitudinal cylinder axis. On the first housing part the fan wheel housing is arranged. The first housing part and the second housing part are in particular die cast parts on which further components are integrally formed. The two housing parts are advantageously made of die cast magnesium. The fan wheel housing is advantageously integrally formed on the first housing part, i.e., is monolithically formed together with it. The injection valve is advantageously also secured on the first housing part.

An independent aspect of the present invention concerns the separation of the crankcase. Advantageously, the crankcase is not divided centrally. The parting plane is advantageously positioned at a spacing relative to an imaginary center plane. The center plane is the plane that contains the longitudinal cylinder axis and that extends perpendicularly to the axis of rotation of the crankshaft. The parting plane and the center plane are two planes that extend parallel to each other. The axis of rotation of the crankshaft forms a straight line that intercepts the center plane and the parting plane at two points spaced apart from each other. The joint plane is extending in particular at the injection valve at the side of the imaginary plane that is remote from the fan wheel housing. At the level of the injection valve the joint surface is therefore displaced to the side of the imaginary plane that is remote from the fan wheel housing. Advantageously, the joint surface extends completely at the side of the imaginary plane that is remote from the fan wheel housing. The spacing is advantageously approximately 10% up to approximately 50% of the width of the crankcase interior measured parallel to the axis of rotation of the crankcase. It is particularly advantageous when the spacing is 30% to 40% of the width of the crankcase interior.

It has been found that the first housing part in operation as a result of cooling of the fan wheel housing by the fan wheel is significantly cooler than the second housing part. At the same time, the first housing part, as a result of the asymmetric arrangement of the joint surface relative to the center plane has a greater mass than the second housing part as well as a larger surface area. As a result of the greater mass the second housing part is heated slower than the first housing part. The greater surface area effects a faster heat transfer to the environment. By arranging the injection valve on the first housing part that is cooled a reduced heating of the injection valve is achieved. The joint surface is advantageously displaced toward the second housing part, at least in the area in which the receiving opening for the injection valve, respectively, the holder supporting the injection valve is arranged. The spacing between parting plane and center plane is advantageously provided at least in the area in which the receiving opening is arranged in a projection in the direction of the axis of rotation of the crankshaft onto the parting plane. The parting plane advantageously does not intercept a receiving opening for the injection valve that is formed on the crankcase. Since the parting plane adjacent to the injection valve is displaced toward the second housing part; sufficient space is available at the first housing part for the arrangement of the receiving opening, respectively, the injection valve.

The described arrangement of the joint surface and the arrangement of the injection valve on the housing part where the fan wheel is arranged represent an independent aspect of the invention that can be advantageous also independent of the arrangement of the connecting opening at the back wall of the fan wheel housing. The temperature difference between the first and the second housing part can be within a magnitude of approximately 10 K. This temperature difference between first and second housing parts, depending on the operational state of internal combustion engine and the pressure in the fuel system, can be decisive for a reliable fuel supply by means of the injection valve.

The components of the power tool that must be cooled are advantageously arranged on the first housing part. In this connection, in particular the injection valve is secured on the first housing part. In this connection, it is advantageously provided that the holder in which the injection valve is arranged is arranged on the first housing part, namely at a receiving opening formed on the first housing part at the outer circumference of the crankcase. The holder for the injection valve is advantageously sealed in the receiving opening by means of a radial seal. In order to enable an excellent radial sealing action of the holder, the receiving opening is advantageously completely formed in the first housing part. Since the holder is radially sealed, additional fastening means such as fastening screws are provided only for securing the holder on the crankcase. Therefore, by means of the securing means such as screws no sealing forces must be applied. The sealing forces are defined by the dimensions of the seal and of the receiving opening and are independent of the tightening force of the fastening screws. With this configuration, a reliable and simple sealing action can be achieved. Advantageously, the internal combust combustion engine has at least one sensor which is arranged on the outer circumference of the crankcase on the first housing part. The sensor is advantageously arranged at the exterior side of the crankcase. An arrangement in the interior of the crankcase on the crankcase wall forming the outer circumference of the crankcase may be advantageous also. Minimal temperatures are achieved also for the sensor as a result of the arrangement on the first housing part. The sensor can be, for example, a pressure sensor, a temperature sensor or a combined pressure temperature sensor. Also, the arrangement of several sensors on the first housing part can be advantageous.

The internal combustion engine has advantageously a cylinder which is attached to a cylinder connecting flange on the crankcase. The cylinder connecting flange extends advantageously perpendicular to the longitudinal cylinder axis and in particular perpendicular to the joint surface between the two housing parts of the crankcase. A first section of the cylinder connecting flange is advantageously formed by the first housing part and a second section of the cylinder connecting flange by the second housing part. By configuring the cylinder connecting flange at both housing parts, demoulding of the housing parts when producing them by die casting is enabled in the direction of the axis of rotation of the crankshaft. In this way manufacture is simplified.

DESCRIPTION OF THE PREFERRED EMBODIMENTS

Figure 1:
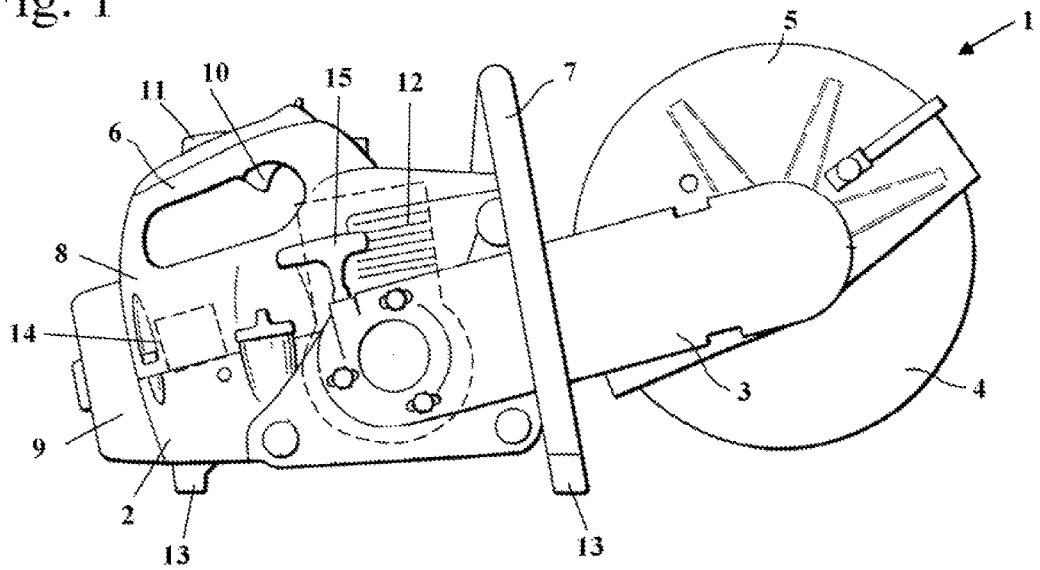
FIG. 1 is a side view of a cut-off machine.

FIG. 1 shows as an embodiment of a power tool a hand-guided cut-off machine 1. The present invention is also advantageous for other power tools, in particular for hand-guided power tools such as motor chainsaws, trimmers, blowers or the like. The power tools can be hand-carried or can be carried as a backpack or can be pushed across the ground, for example, in the case of lawnmowers or cut-off machines with carriage.

The cut-off machine 1 has a housing 2 on which a cantilever arm 3 is secured. At the free end of the cantilever arm 3 a cutter wheel 4 is rotatably supported which is partially covered by a protective cover 5 about its circumference. For guiding the cut-off machine 1 a top handle 6 is provided that is monolithically formed with a hood 8 of the housing 2 and a grip pipe or handlebar 7 that spans the housing 2 at the front side of the housing 2 facing the cutter wheel 4 are provided. At the top handle 6 a throttle trigger 10 as well as a throttle lock 11 are pivotably supported. Instead of the top handle 6 also a rear handle can be provided. At the side of the housing 2 that is facing away from the cutter wheel 4, an air filter cover 9 is secured on the housing 2. In the housing 2 an internal combustion engine 12 is arranged that is to be started by a starter device. The starter device can be actuated by means of a starter grip 15. However, also an electric starter device can be provided. In the housing 2 there is also a fuel pump 14 is arranged also, schematically shown in FIG. 1, that serves for conveying fuel to the internal combustion engine 12. The cut-off machine 1 has support legs 13 with which it can be placed onto the ground or any other support surface.

Figure 2:
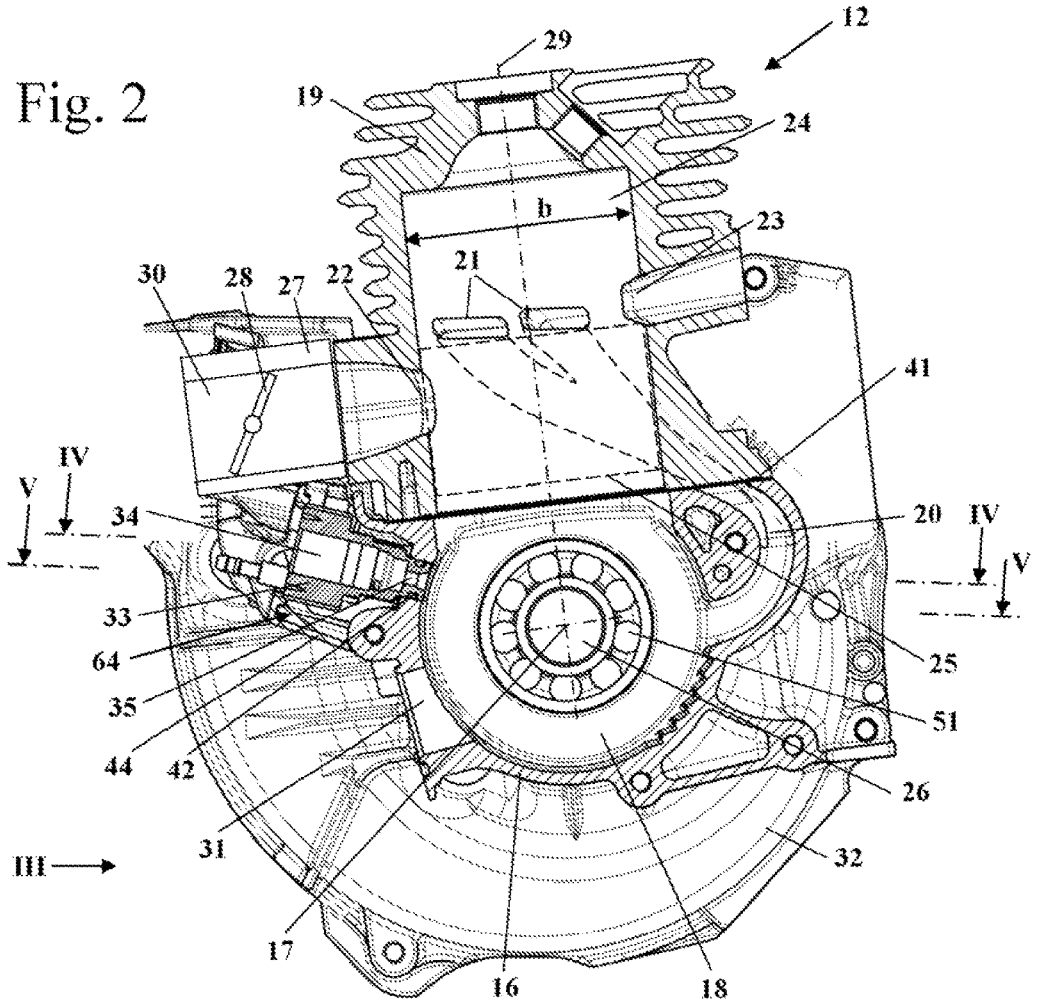
FIG. 2 is a section view, partially schematic; of an internal combustion engine of the cut-off machine of FIG. 1.

FIG. 2 shows the internal combustion engine 12 in detail. The internal combustion engine 12 has a cylinder 19 that is placed at the parting plane 41 onto the crankcase 16. In the crankcase 16 a crankshaft 26 is supported so as to the rotatable about axis of rotation 17 by bearings 51 that may be embodied as ball bearings. The crankshaft 26 is supported on both sides of a connecting rod (not shown in the Figures) that provides a connection to the piston. A first bearing 51 is arranged in the first housing part 36 and a second bearing 51 in the second housing part 37. The crankshaft 26 is rotatingly driven by piston 25 that is reciprocatingly supported in the cylinder 19 in the direction of the longitudinal cylinder axis 29. The piston 25 delimits a combustion chamber 24 formed in the cylinder 19. The cylinder 19 has an inner diameter b. The inner diameter b is the diameter of the bore that is formed in the cylinder 19 and in which the piston 25 is arranged. An inlet 22 opens at the cylinder 19 and is controlled by the piston 25. The inlet 22, when the piston 25 is positioned at top dead center, is connected with the crankcase interior 18 and supplies combustion air into the crankcase interior 18. The combustion air is supplied through intake passage 30 that extends with a portion thereof in a throttle housing 27. In the throttle housing 27 a throttle element is pivotably supported, in the illustrated embodiment in the form of a throttle flap 28, and the throttle trigger 10 is acting on this throttle element. An outlet 23 extends away from the combustion chamber 24 and is also controlled by the piston 25.

On the outer circumference of the crankcase 16 a holder 33 is arranged that is sealed by means of radial seal 42 relative to the crankcase 16. In the holder 33 a receptacle 34 for an injection valve 43 (FIG. 6) is formed. The injection valve 43 supplies the fuel directly into the crankcase interior 18 by means of an outlet passage 35 formed in the holder 33. The crankcase 16 has also a mounting opening 31 for a sensor that is also not shown in FIG. 2. The holder 33 is arranged immediately below the inlet 22 of the throttle housing 27 and the mounting opening 31 is arranged on the side of the holder 33 that is facing away from the throttle housing 27. The crankcase interior is connected by one or several transfer passages 22 to the combustion chamber 24. In the illustrated embodiment a transfer passage 20 is provided that branches into several branch passages and opens with several transfer ports 21 into the combustion chamber 24. The transfer ports 21 are also controlled by the piston 25 and, when the piston 25 is at bottom dead center, the ports 21 open into the combustion chamber 24.

When the piston 25 is at top dead center, combustion air is sucked in from the intake passage 30 through inlet 22 into the crankcase interior 18 in operation of the internal combustion engine. The combustion air is compressed upon downward stroke of the piston 25 in the crankcase interior 18. Through the injection valve 43 (FIG. 6) fuel is supplied also into the crankcase interior 18. The fuel/air mixture flows through the transfer passage 20 and transfer ports 21 into the combustion chamber 24 when the piston 25 is at bottom dead center. Upon upward stroke of the piston 25 the fuel/air mixture in the combustion chamber 24 is compressed and is ignited by a spark plug (not shown) when the piston 25 is at top dead center. The piston 25 is accelerated by the combustion in the combustion chamber 24 in the direction of bottom dead center. As soon as the outlet 23 has been opened by piston 25, the exhaust gases flow out of the cylinder 19 into the exhaust gas muffler (not shown in the drawing) that is connected to the outlet 23.

Figure 3:
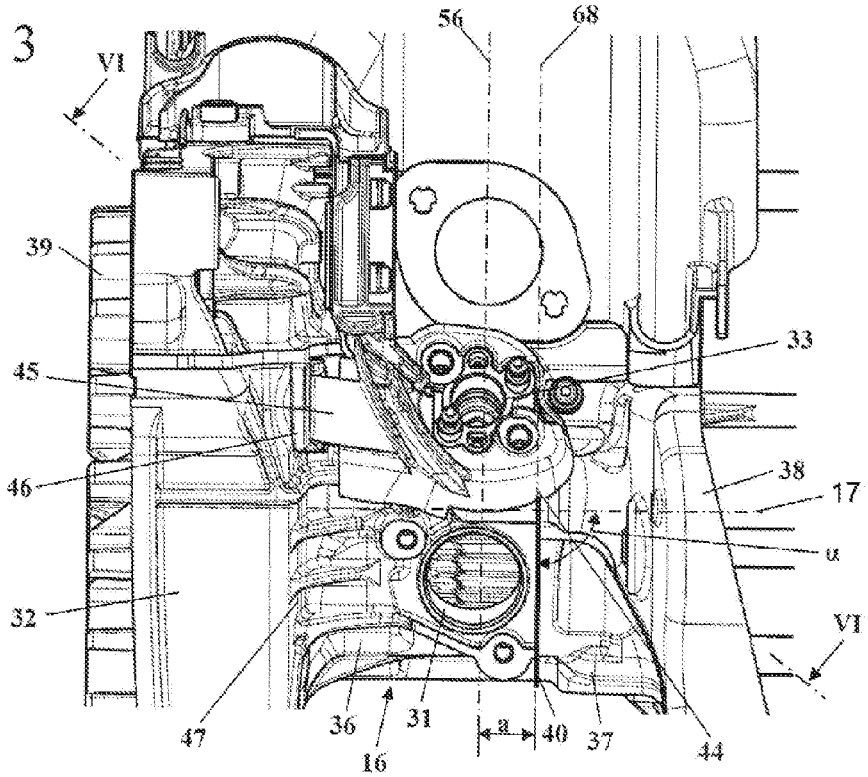
FIG. 3 is a side view of the crankcase of the internal combustion engine in the direction of arrow III in FIG. 2.

As shown in FIG. 2, the holder 33 is arranged in a cooling area 64 which is covered by an air guiding component 44 and which is separated to a large extent from the environment. FIG. 3 shows the air guiding component 44 in detail. On the air guiding component 44 an air guiding passage 45 is formed that extends to a connecting socket 46. The connecting socket 46 is secured in a back wall 47 of a fan wheel housing 32 in the fan wheel housing 32 a fan wheel 35 is arranged that is rotatingly driven by the crankshaft 26. The fan wheel 39 is advantageously connected fixedly with the crankshaft 26.

The crankcase 16 comprises a first housing part 36 and a second housing part 37 between which a joint surface 40 is formed. The two housing parts 36 and 37 are advantageously resting on each other at the joint surface 40 with interposition of a gasket, in particular a paper gasket. The joint surface 40 can be, for example, approximately part-circular. The joint surface 40 extends in the illustrated embodiment parallel to an imaginary center plane 56 illustrated in FIG. 3. The center plane 56 contains the longitudinal cylinder axis 29 and extends perpendicular to the axis of rotation 17 of the crankshaft 26. The joint surface 40 may have one or several steps. The joint surface 40 is positioned at least partially in an imaginary parting plane 68. In the illustrated embodiment, the joint surface 40 has no steps and is positioned completely within the parting plane 68. The angle $\alpha$ between the imaginary parting plane 68 and the axis of rotation 17 of the crankshaft 26, schematically indicated in FIG. 3, is 90°. The center plane 56 corresponds to the section plane of FIG. 2. As is shown in FIG. 3, the joint surface 40 and thus also the parting plane 68 have relative to the center plane 56 a spacing a. The joint surface 40 and thus also the parting plane 68 have a greater spacing to a back wall 47 of the fan wheel housing 32 that is facing the crankcase 16 than the center plane 56. The spacing $\alpha$ is advantageously at least approximately 10%, in particular at least approximately 15%, of the inner diameter b of the cylinder 19. The spacing a is advantageously approximately 10% to approximately 50% in particular 20% to 40%, of the width c (see FIG. 4) of the crankcase interior 18 that is measured parallel to the axis of rotation 17 of the crankshaft 26. In the illustrated embodiment, the spacing a is approximately 30% of the width c of the crankcase interior 18. The joint surface 40 is displaced relative to the center plane 56 in the direction toward a mounting flange 38 that is formed on the second housing part 37. On the mounting flange 38, a centrifugal clutch of the cut-off machine 1, a pulley for driving the drive belt for the cutter wheel 4, as well as a starter device for the internal combustion engine 12 can be arranged. Advantageously, the cantilever arm 3 is secured on the mounting flange 38.

The spacing a is advantageously provided adjacent to the injection valve 43, i.e., in the projection of the receiving opening 52 (FIG. 7) for the holder 33 onto the center plane 56 in the direction of the axis of rotation 17 of the crankshaft 26. The parting plane 68 extends advantageously outside of the receiving opening 52 on the side of the receiving opening 52 that is remote from the fan wheel housing 32.

Figure 4:
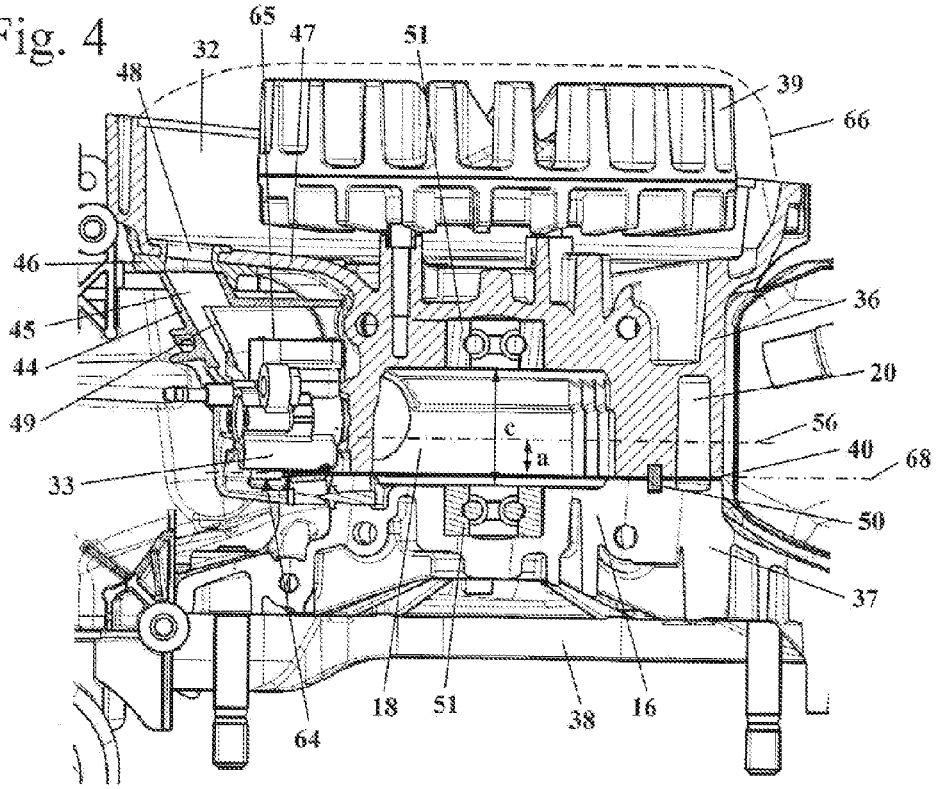
FIG. 4 is a section view along the line IV-IV of FIG. 2 wherein the holder of the injection valve is not shown in section.

As shown in FIGS. 3 and 4, the holder 33 is completely arranged on the first housing part 36 so that also the injection valve 43 is secured only on the first housing part 36 and has no direct contact with the second housing part 37. As shown in FIG. 3, the mounting opening 31 is also formed completely on the first housing part 36.

Figure 5:
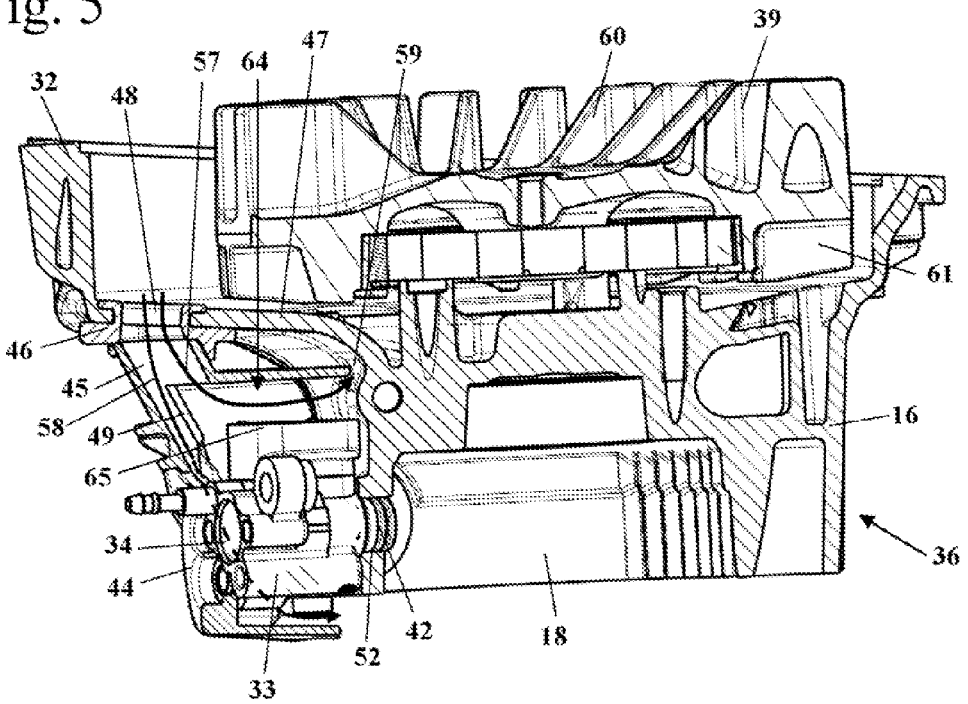
FIG. 5 is a section view of the first housing part of the crankcase along the section line V-V in FIG. 2 wherein the holder of the injection valve is not shown in section.

As shown in FIGS. 3 and 4, the back wall 47 of the fan wheel housing 32 that is facing the crankcase 16 has a connecting opening 48 in which the connecting socket 46 is secured (see also FIG. 5). The air guiding passage 45 adjoins the connecting opening 48. In the air guiding passage 45 a flow guiding rib 45 is formed that divides the supplied air into several partial streams. The air guiding component 44 is comprised of plastic material. The holder 33 penetrates the cooling area 64 that is delimited by the air guiding component 44. The fan wheel 39 is covered by the fan wheel cover 66 relative to the environment (the cover is schematically shown in FIG. 4). The fan wheel cover 66 is secured on the fan wheel housing 32.

FIG. 4 shows also the gasket 50 arranged between the housing parts 36 and 37. The gasket 50 seals the transfer passage 20 relative to the crankcase interior 18. In addition, on the joint surface 40 a paper gasket for sealing relative to the environment is provided advantageously.

FIG. 5 shows that the fan wheel 39 has at the side that is facing away from the crankcase 16 a front vane arrangement 60 and on its side that is facing the back wall 47 of the fan wheel housing 32 a rear vane arrangement 61. The fan wheel housing 32 delimits a cooling air spiral, in an overpressure area of the cooling air spiral the connecting opening 48 is arranged. In this way, the cooling air that is conveyed by the fan wheel 39 is forced through the connecting opening 48 and the air guiding passage 45 into the cooling area 64. On the holder 33 a fuel pressure damper 65 is integrated that is arranged immediately upstream of the injection valve in the flow path of the fuel. The fuel pressure damper 65 is also cooled by the cooling air conveyed through the connecting opening 48. The cooling air flows in the direction of arrow 57 past the fuel pressure damper 65 through a gap 59 that is formed between the air guiding component 44 and the wall of the crankcase 16. The cooling air flows also across the opposite side of the flow guiding rib 49 in the direction of arrow 58. The cooling air that flows in the direction of arrow 58 flows about the holder 33 and exits at the side of the holder 33 that is facing away from the fan wheel housing 32 between crankcase 16 and air guiding component 44. Advantageously, the gap 59 is designed to be circumferentially extending so that cooling air can exit across the entire rim of the air guiding component 44.

FIG. 5 shows also that the receptacle 34 that is formed in the holder 33 for the injection valve 43 is open relative to the environment but not relative to the cooling area 44. The cooling air that is conveyed underneath the air guiding component 44 does not cool the injection valve directly but flows about and cools the holder 33 so that an excessive heating of the injection valve 43 is prevented.

As also shown in FIG. 5, the holder 33 is arranged in a receiving opening 52 of the crankcase 16 and is sealed relative thereto by a radial seal 42. As shown also in FIG. 5, the receiving opening 52 is formed completely within the first housing part 36 so that the radial seal 42 must not extend across the joint surface 40 between the two housing parts 36 and 37.

Figure 6:
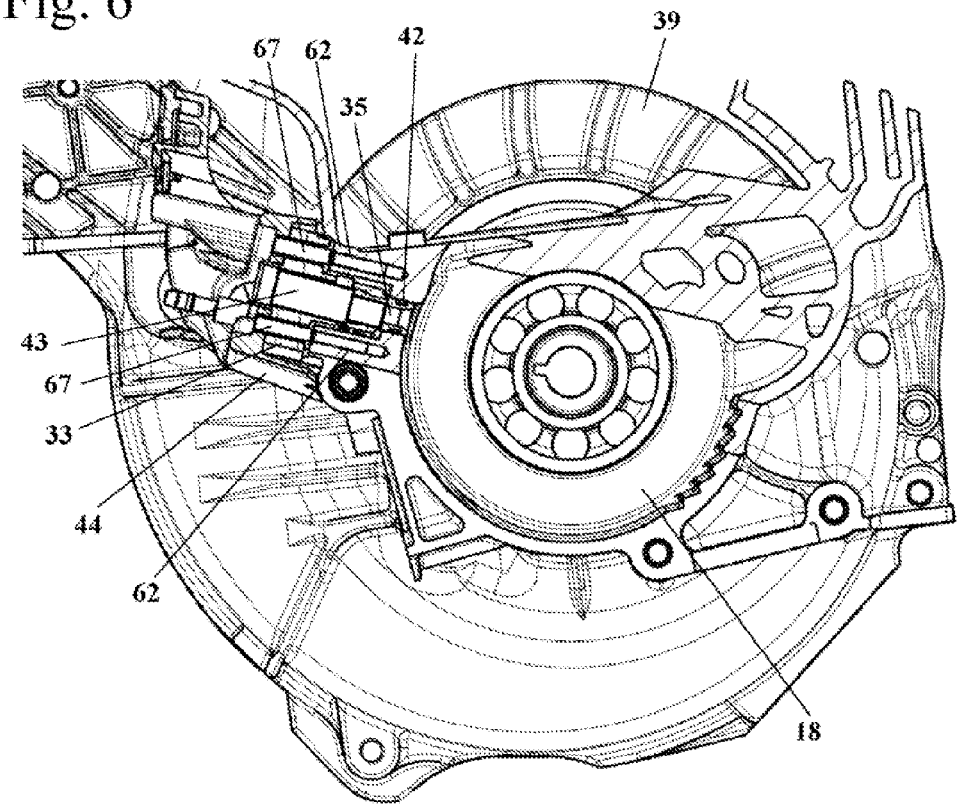
FIG. 6 is a section view of the first housing part and of the holder of the injection valve along the line VI-VI in FIG. 3.

FIG. 6 shows schematically the injection valve 43 that is arranged in the holder 33. The fuel that is metered in through the injection valve 43 passes through the outlet passage 35 into the crankcase interior 18.

Figure 7:
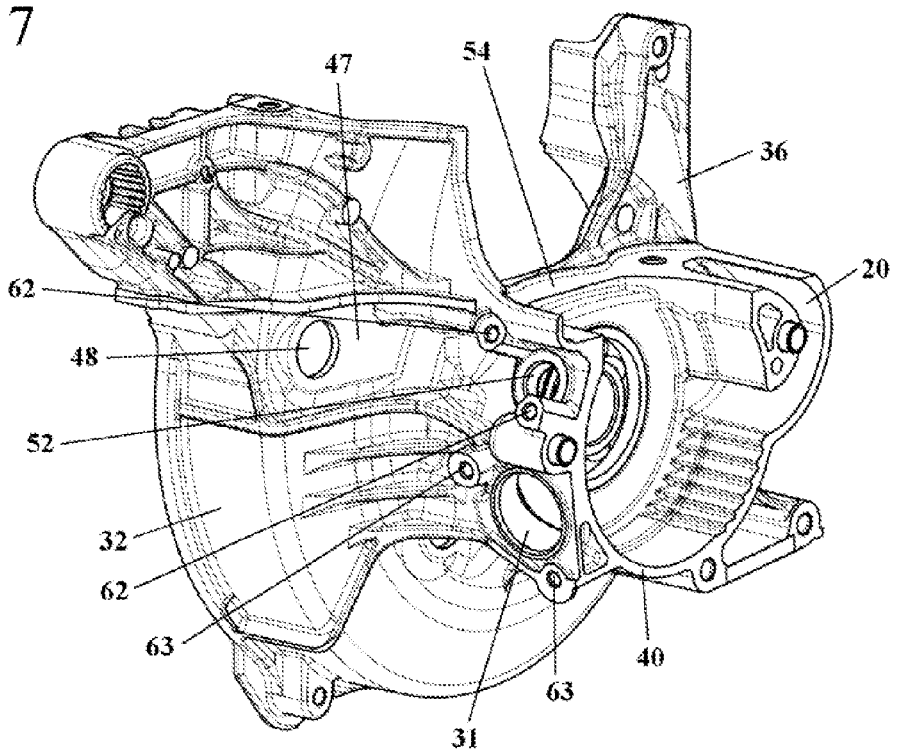
FIG. 7 is a perspective illustration of the first housing part of the crankcase.

FIG. 7 shows the arrangement of the connecting opening 48 in the back wall 47 of the fan wheel housing 32. The air guiding component 44 is not shown and the holder 33 is also not shown. FIG. 7 shows two fastening openings 62 on the first housing part 36 by means of which the holder 33 can be screw-connected to the crankcase 16. As shown in FIG. 6, fastening screws 67 are screwed into the fastening openings 62 and secure also the air guiding component 44. No additional fastening openings or fastening means are therefore required for fixation of the air guiding component 44.

Figure 8:
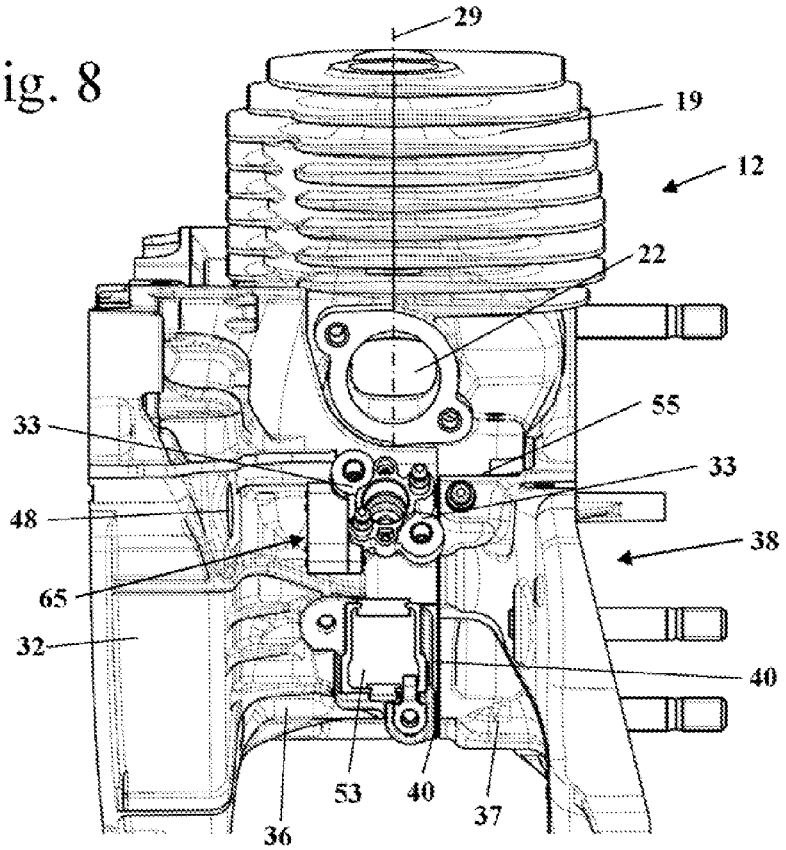
FIG. 8 is a side view of the internal combustion engine in the direction of arrow III in FIG. 2.

As shown in FIG. 7, adjacent to the mounting opening 31 two fastening openings 63 for attachment of a sensor in the mounting opening 31 are provided. The sensor 53 is shown in FIG. 8. The sensor 53 is a combined pressure and temperature sensor. As also shown in FIG. 7, the section of the transfer passage 20 which is formed in the crankcase 16 is also divided by the joint surface 40. This is also shown in FIG. 4. On the side that is facing the cylinder 19 a first section 54 of a cylinder connecting flange is formed on the first housing part 36. The cylinder 19 is secured on the cylinder connecting flange advantageously with interposition of a gasket. The gasket is in particular a paper gasket. This gasket between crankcase 16 and cylinder 19 effects an additional thermal insulation of cylinder 19 and crankcase 16 that reduces the heat transmission from the cylinder 19 into the crankcase 16. As shown in FIG. 8, a second section 55 of the cylinder connecting flange is formed on the second housing part 37. The first housing part 36 as well as the second housing part 37 delimit the cylinder connecting flange. In this way, both housing parts 36 and 37 can be demoulded in the direction of the axis of rotation 17 of the crankshaft 26 when produced by die casting. Only for forming the openings for the injection valve 43 and the sensor 53 additional slides are required, or these openings must be separately produced.

As shown in FIG. 8, the holder 33 and the fuel pressure damper 65 are arranged immediately adjacent to the connecting opening 48. In this way, the cooling air conveyed by the fan wheel 39 flows immediately about the holder 33 with injection valve 43 and the fuel pressure damper 65.

As an alternative, it may be provided to arrange the connecting opening 48 in the underpressure area of the fan wheel. The injection valve 43 is then cooled by the cooling air that is sucked in by the fan wheel.

The holder 33 as well as the air guiding component 44 are comprised of plastic material. The components thus act as insulators so that the heat transfer from the crankcase to the injection valve is bad. In this way, even when the machine is shut down, it can be ensured that the injection valve is not heated too much even when the fan wheel is no longer driven but the crankcase and the cylinder are still hot. By arranging the injection valve on the crankcase, heating of the injection valve is reduced significantly in comparison to the arrangement on the cylinder. Alternatively, the holder 33 could be completely or partially made of metal. A configuration is particularly advantageous in which areas of the holder 33 that are in contact with the crankcase 16 are made of plastic material and effect an insulation relative to the crankcase 16. The area of the holder 33 that is not directly in contact with the crankcase 16 but is exposed to the flow of cooling air can advantageous be made of metal so that the heat in the holder 33 can be dissipated by means of the metallic section into the environment, in particular transferred to the cooling air. Alternatively or additionally, it can be provided that the holder 33 is provided in the area that is exposed to the cooling air has at least one cooling rib for improving the heat transfer to the cooling air. Advantageously, the injection valve 43 itself can also be contact with the cooling air and/or have at least one cooling surface that is formed advantageously on a cooling rib.

The fan wheel housing 32 in the illustrated embodiment is formed integrally on the first housing part 36 of the crankcase 16. However, it can also be advantageous to embody the air filter housing 32 as a separate component. The air filter housing 32 can be of a single-part or a multi-part configuration and can be comprised at least partially of plastic material. The air filter housing 32 can also be formed or delimited partially or completely, by neighboring components.

The specification incorporates by reference the entire disclosure of German priority document 10 2011 120 464.8 having a filing date of Dec. 7, 2011.

While specific embodiments of the invention have been shown and described in detail to illustrate the inventive principles, it will be understood that the invention may be embodied otherwise without departing from such principles.

What is claimed is:

1. A power tool comprising:

an internal combustion engine comprising:

an injection valve through which fuel is supplied to the internal combustion engine;

a crankcase comprising a crankcase interior;

a cylinder connected to the crankcase;

a crankshaft arranged in the crankcase interior so as to be rotatable about an axis of rotation;

a fan wheel housing;

a fan wheel arranged in the fan wheel housing and conveying cooling air to the internal combustion engine;

wherein the crankcase comprises a first housing part and a second housing part embodied separate from the first housing part, wherein the first and the second housing parts are joined to each other at a joint surface, wherein the first housing part and the second housing part delimit the crankcase interior;

wherein the cylinder is embodied separate from the first and second housing parts;

wherein the cylinder is placed onto a cylinder connecting flange of the crankcase, wherein a first section of the cylinder connecting flange is formed by the first housing part and a second section of the cylinder connecting flange is formed by the second housing part;

wherein the joint surface is at least partially positioned in an imaginary parting plane extending perpendicularly to the axis of rotation of the crankshaft;

wherein the fan wheel housing and the injection valve are arranged on the first housing part;

wherein the internal combustion engine has an imaginary center plane;

wherein the internal combustion engine has a longitudinal cylinder axis that is located in the imaginary center plane;

wherein the imaginary center plane extends perpendicularly to the axis of rotation of the crankshaft;

wherein the parting plane has a spacing relative to the imaginary center plane and wherein the parting plane extends at the side of the imaginary center plane that is remote from the fan wheel housing.

2. The power tool according to claim 1, further comprising a gasket interposed between the first housing part and the second housing part at the joint surface.

3. A power tool comprising:

a mixture-lubricated two-stroke internal combustion engine;

a fan wheel conveying cooling air to the two-stroke internal combustion engine;

a fan wheel housing comprising a back wall;

the two-stroke combustion engine comprising:

a crankcase;

a crankcase interior;

a cylinder comprising a bore;

a combustion chamber;

a piston reciprocatingly supported in the bore of the cylinder;

an intake passage;

a cooling area arranged on an exterior side of the crankcase;

a crankshaft; and a fuel injection valve;

wherein the crankcase delimits the crankcase interior;

wherein the crankshaft is arranged in the crankcase interior so as to be rotatable about an axis of rotation;

wherein the crankshaft is driven in rotation about the axis of rotation by the piston;

wherein the intake passage opens into the bore of the cylinder through an inlet provided at a circumference of the bore of the cylinder, wherein the inlet is piston-controlled by the piston;

wherein the fuel injection valve supplies fuel into the crankcase interior;

wherein the fan wheel is arranged in an interior of the fan wheel housing;

wherein the back wall of the fan wheel housing is facing the crankcase;

wherein a connecting opening is formed in the back wall and the connecting opening connects an interior of the fan wheel housing to the cooling area;

wherein the fuel injection valve is arranged in the cooling area, wherein cooling air is supplied by the fan wheel to said cooling area;

wherein, in a position of the two-stroke combustion engine in which a longitudinal cylinder axis is vertically arranged and the crankcase interior is positioned at least partially below the combustion chamber, the fuel injection valve is arranged below the intake passage;

wherein the fan wheel conveys the cooling air from the interior of the fan wheel housing through the connecting opening in the back wall of the fan wheel housing into said cooling area on the exterior side of the crankcase so that the fuel injection valve is cooled separate from a cooling action that is cooling the cylinder.

4. The power tool according to claim 3, wherein the connecting opening is arranged in an overpressure area of the fan wheel housing.

5. The power tool according to claim 3, wherein the internal combustion engine further comprises a holder of plastic material that is attached to the crankcase, wherein the injection valve is arranged in the holder and wherein the holder is arranged at least partially in the cooling area.

6. The power tool according to claim 5, wherein the holder is arranged on a receiving opening formed in the first housing part at an outer circumference of the crankcase.

7. A power tool comprising:

an internal combustion engine;

a fan wheel housing comprising a back wall; and a fan wheel disposed in the fan wheel housing;

the combustion engine comprising:

an injection valve supplying fuel;

a cylinder having a longitudinal cylinder axis;

a crankcase;

a crankcase interior; and a crankshaft;

wherein the crankcase interior is embodied in the crankcase;

wherein the crankshaft is arranged in the crankcase interior so as to be rotatable about an axis of rotation;

wherein the internal combustion engine has an imaginary center plane;

wherein the imaginary center plane extends perpendicularly to the axis of rotation of the crankshaft and contains the longitudinal cylinder axis;

wherein the crankcase comprises a first housing part and a second housing part, wherein the first housing part and the second housing part delimit the crankcase interior, wherein the second housing part is embodied separate from the first housing part;

wherein the crankcase comprises a joint surface, wherein the first and the second housing parts are joined to each other at the joint surface;

wherein the joint surface is at least partially positioned in an imaginary parting plane extending perpendicularly to the axis of rotation of the crankshaft;

wherein at least one portion of the back wall of the fan wheel housing is formed as one piece together with the first housing part;

wherein the injection valve is mounted on the first housing part;

wherein the at least one portion of the back wall of the fan wheel housing formed as one piece together with the first housing part and the imaginary parting plane are arranged on opposite sides of the imaginary center plane.

8. The power tool according to claim 7, wherein the imaginary center plane has a spacing relative to the imaginary parting plane, wherein the spacing is approximately 10% to approximately 50% of a width of the crankcase interior measured parallel to the axis of rotation of the crankshaft.

9. The power tool according to claim 7, wherein the internal combustion engine has at least one sensor arranged on an outer circumference of the crankcase on the first housing part.

10. The power tool according to claim 7, further comprising a gasket interposed between the first housing part and the second housing part at the joint surface.

* * * * *